US005320228A

United States Patent [19]

Chen

[11] Patent Number: 5,320,228

[45] Date of Patent: Jun. 14, 1994

[54] COAT RACK

[76] Inventor: Shou-Mao Chen, No. 7-3, Lane 2, Ta An Kang Rd., Ta Chia Chen, Taichung Hsien, Taiwan

[21] Appl. No.: 995,133

[22] Filed: Dec. 22, 1992

[51] Int. Cl.[5] ..... A47F 5/00

[52] U.S. Cl. ..... 211/124; 206/291; 248/316.1

[58] Field of Search ..... 211/124, 113; 206/279, 206/287, 287.1, 291; 248/316.1, 316.5, 316.6

[56] References Cited

U.S. PATENT DOCUMENTS 4,363,388 12/1982 London et al. ..... 206/287 X
4,753,342 6/1988 Pulichino et al. ..... 248/316.1 X
4,769,878 9/1988 Liao ..... 211/124 X
4,850,562 7/1989 Mazzanti ..... 211/124 X
4,852,845 8/1989 Lener ..... 211/124 X
4,858,870 8/1989 Mazzanti ..... 211/124 X
4,907,774 3/1990 Shaw et al. ..... 211/124 X
5,018,627 5/1991 Moore ..... 206/291 X
5,048,785 9/1991 Shaw et al. ..... 211/124 X
5,099,989 3/1992 Goodin et al. ..... 206/291 X

*Primary Examiner*—Robert W. Gibson, Jr.
*Attorney, Agent, or Firm*—Morton J. Rosenberg; David I. Klein

[57] ABSTRACT

A coat rack is disclosed having a plurality of resilient hook members fastened inside a chamber thereof and respectively disposed above a respective transverse groove for holding clothes by hangers. Each resilient hook member has a bottom hook controlled by a respective knob to close or open the respective transverse groove for hanging or removing a dress hanger.

1 Claim, 6 Drawing Sheets

COAT RACK

BACKGROUND OF THE INVENTION

The present invention relates to a coat rack to be fastened inside a trunk for holding clothes by hangers.

An ordinary coat rack for use in a trunk to hold clothes is shown in FIG. 1, which is generally comprised of a base having an elongated horizontal opening, a lock releasably controlled to lock the elongated horizontal opening, and a series of parallel grooves below the elongated horizontal opening for hanging dress hangers. By unlocking the lock, dress hangers can be inserted through the elongated horizontal opening and respectively hung on the grooves to hold clothes. However, this structure of coat rack is still not satisfactory in function. The main disadvantage of this structure of coat rack is that hanging dress hangers on the grooves to hold clothes or taking them out of the coat rack should be done in proper order, and the dress hangers hanging on the outer side grooves should be all taken out when the dress hanger on an inner side is to be taken out. Therefore, one shall expend much time in arranging clothes.

SUMMARY OF THE INVENTION

The present invention eliminates the aforesaid problem. It is therefore the main object of the present invention to provide a coat rack for use in a trunk which allows dress hangers to be conveniently hung on a series of grooves thereon to hold clothes as well as conveniently removed therefrom in free sequence. According to the present invention, a coat rack is comprised of a base having a top mount for fastening to a trunk on the inside, and a plurality of resilient hook members fastened inside a chamber thereof and respectively disposed above a respective transverse groove for holding clothes by hangers. Each resilient hook member has a bottom hook controlled by a respective knob to close or open the respective transverse groove for hanging or removing a dress hanger conveniently.

DETAILED DESCRIPTION OF THE PREFERRED EMBODIMENT

Figure 1:
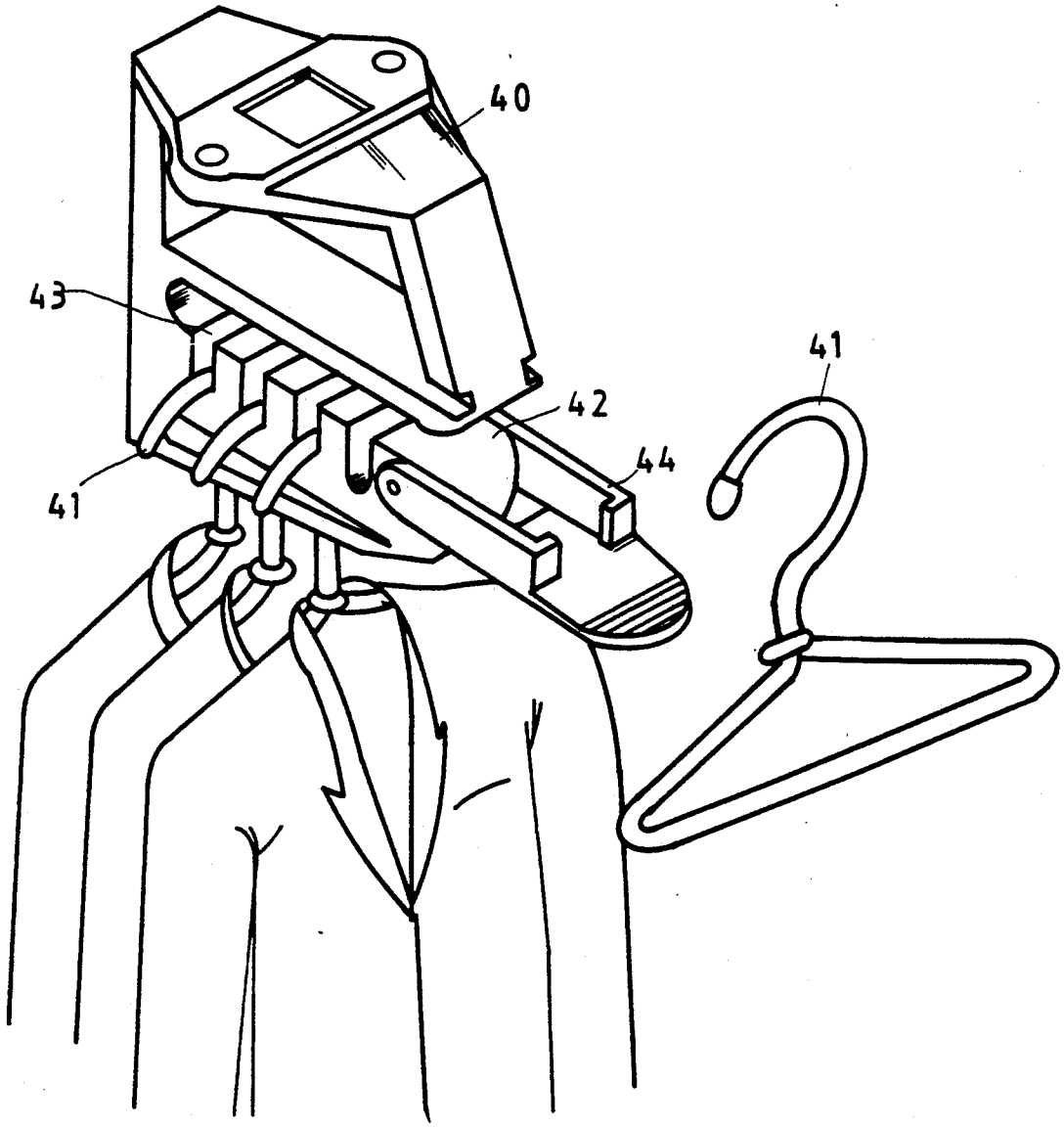
FIG. 1 is an elevational view of a prior art coat rack showing hangers hung thereon to hold clothes.
Figure 2:
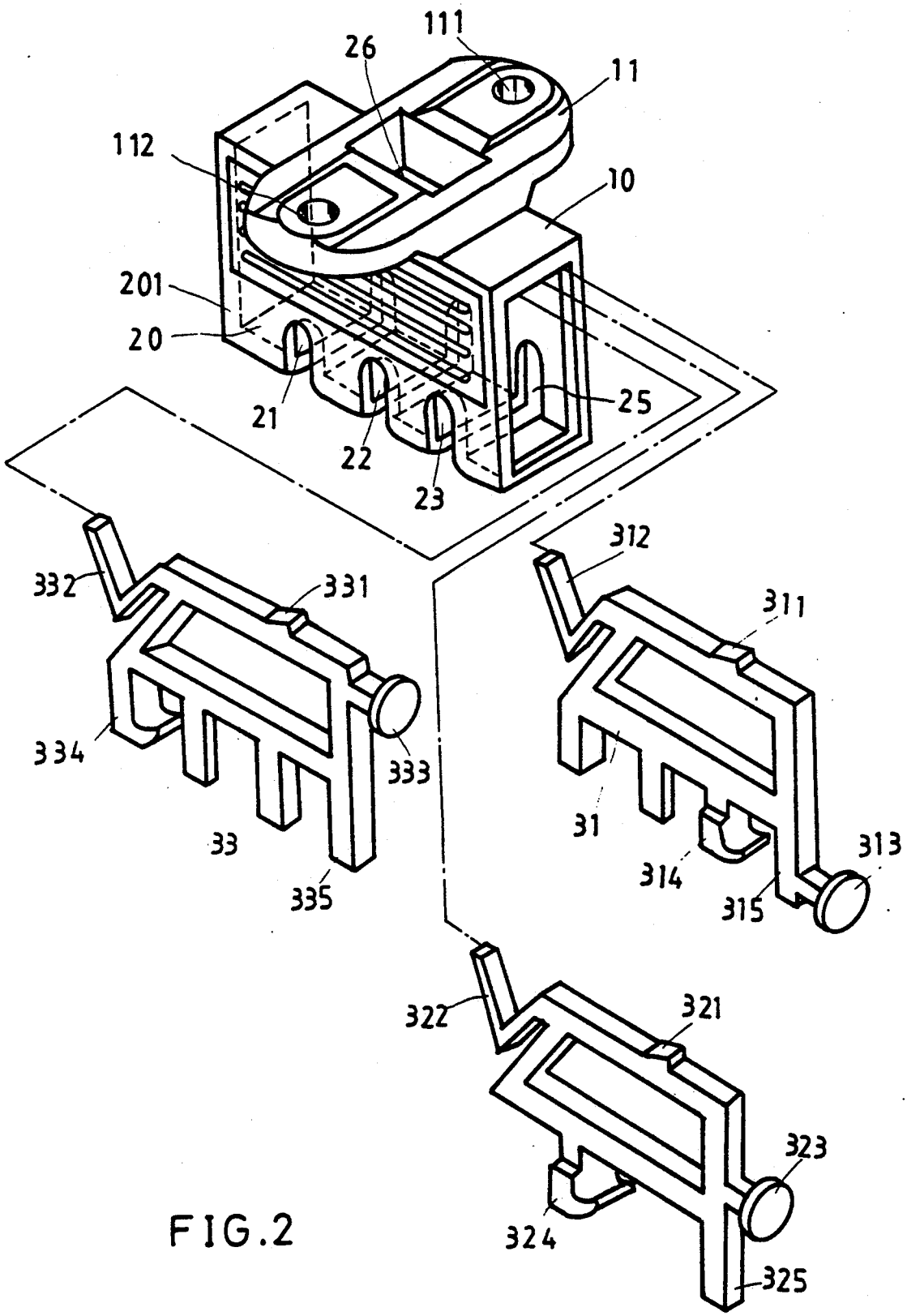
FIG. 2 is a perspective exploded view of a coat rack according to the present invention.
Figure 6:
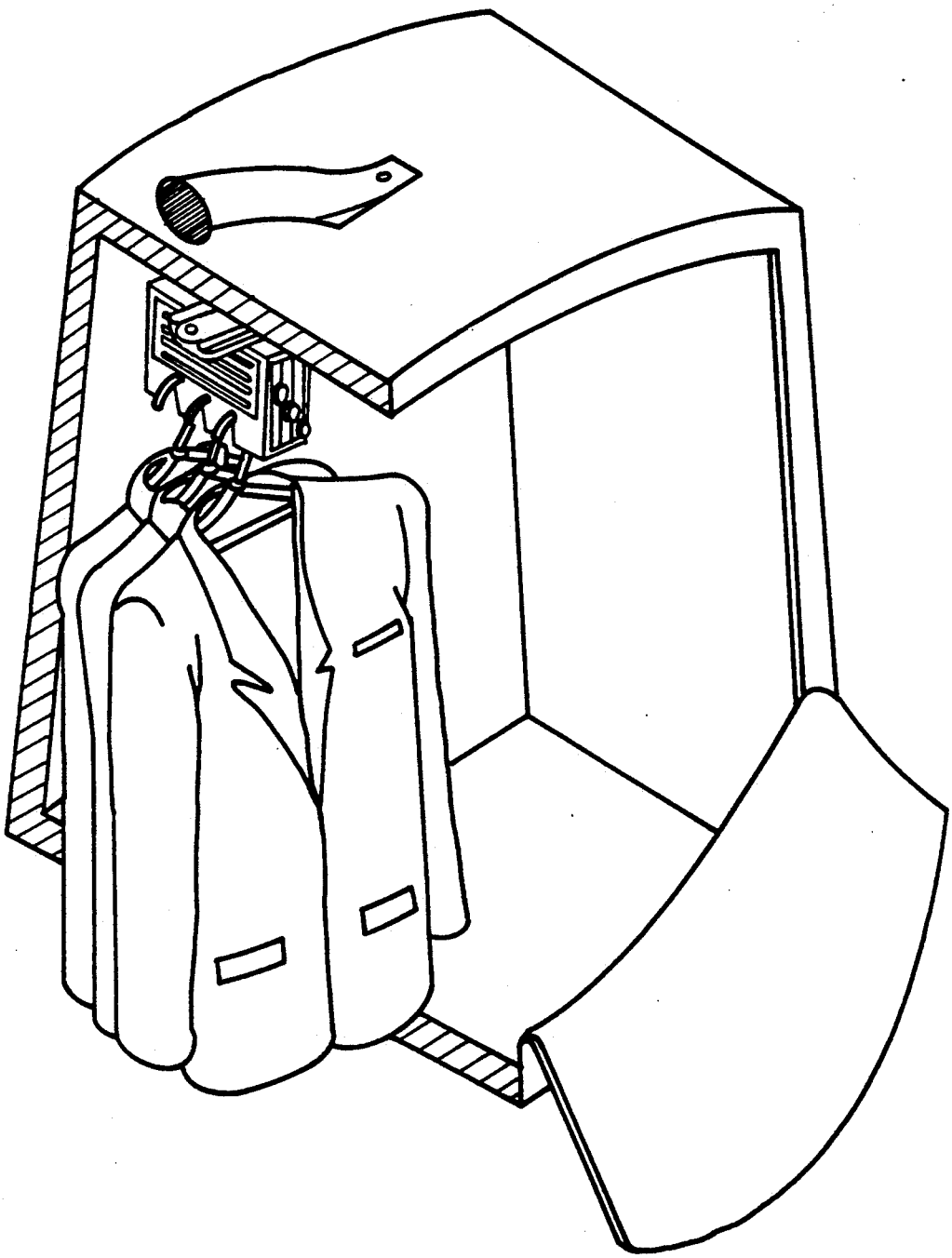
FIG. 6 is an installed view showing the coat rack of FIG. 2 fastened inside a trunk.

Referring to FIG. 2, a coat rack as constructed according to the present invention is generally comprised of a base 10, a top mount 11, and a plurality of resilient hook members 31,32,33. The top mount 11 is made on the base 10 at the top, having round holes 111,112 through which fastening elements are respectively inserted to fasten the top mount 11 to a trunk on the inside (See FIG. 6). The base 10 has a chamber 20 on the inside, a rectangular front opening 25 on a front end thereof through which the resilient hook members 31,32,33 are inserted into the chamber 20, a square top hole 26 through the top mount 11 plurality of transverse grooves 21,22,23 through the chamber 20 at the bottom. The resilient hook members 31,32,33 have each a triangular stop block 311,321 or 331 at the top, a spring arm 312,322 or 332 at the back, a knob 313,323 or 333 at the front, a bottom hook 314,324 or 334 at the bottom, and a front leg 315,325 or 335.

Figure 3:
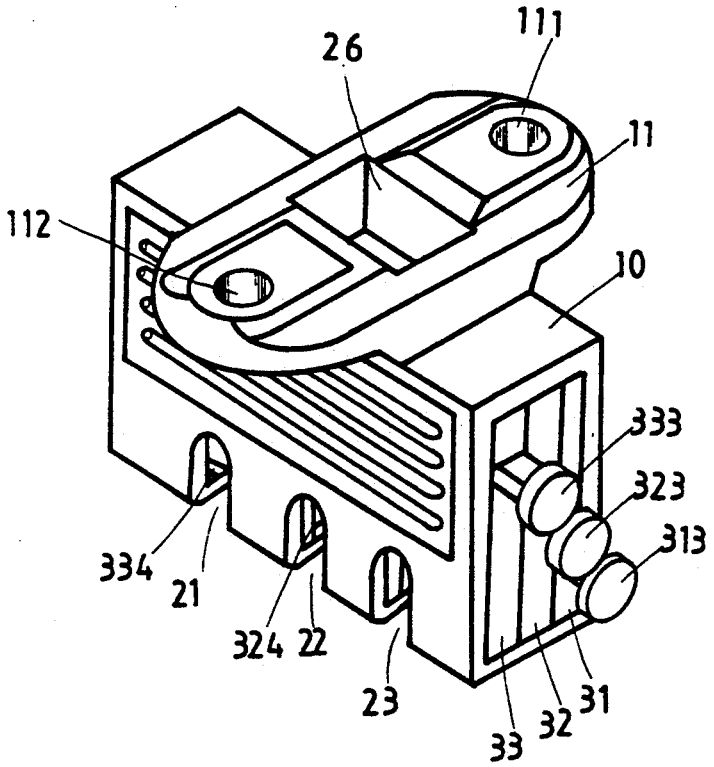
FIG. 3 is an elevational view of the coat rack of FIG. 2.
Figure 4:
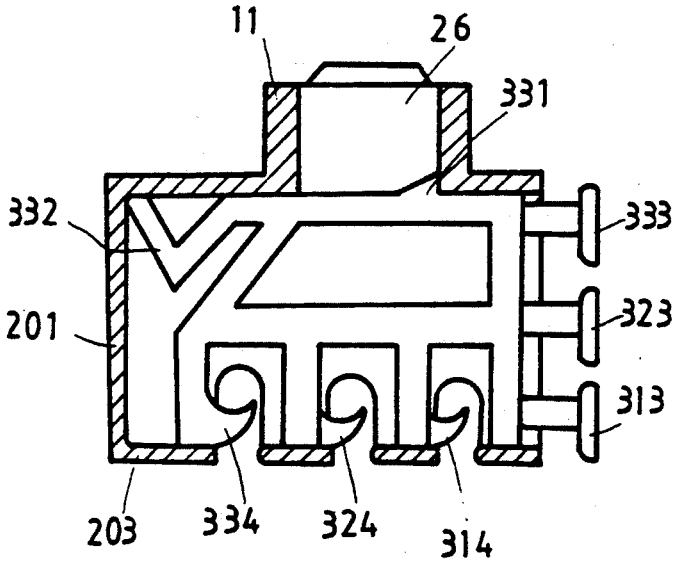
FIG. 4 is a sectional plain view of the coat rack of FIG. 2.

Referring to FIGS. 3 and 4, the resilient hook members 31,32,33 are respectively inserted into the chamber 20 on the base 10 for permitting the triangular stop blocks 311,321,331 to be respectively hooked in the square top hole 26, the spring arms 312,322,332 to be respectively stopped against a back wall 201 on the base 10, the front legs 315,325,335 to be respectively stopped against a front inward flange 202 around the rectangular front opening 25 of the base 10, the bottom hooks 314,324,334 to be respectively disposed over the transverse grooves 21,22,23. When assembled, the bottom hook 314,324 or 334 of each resilient hook member 31,32 or 33 has at least one third of the respective bottom surface supported on the bottom wall 203 of the chamber 20 to bear the load on the respective dress hanger 41 hung thereon.

Figure 5:
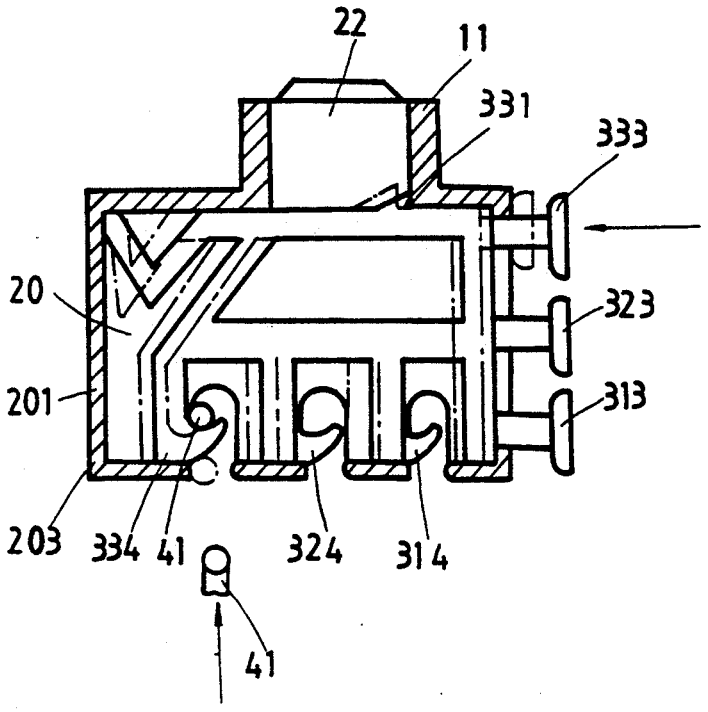
FIG. 5 is another sectional plain view of the coat rack of FIG. 2, showing the bottom hook of one resilient hook member shifted backward for hanging a dress hanger.

Referring to FIG. 5, pressing the knob 313,323 or 333 inward in squeezing the respective spring arm 312,322 or 332 against the back wall 201 causes the respective bottom hook 314,424,334 moved backward for hanging or removing a dress hanger 41. Once the knob 313,323 or 333 is released, the spring arm 312,322 or 333 immediately returns to its original shape causing the bottom hook 314,324,334 to block over the respective transverse groove 21,22 or 23.

What is claimed is:

1. A coat rack comprising a base having a top mount fastened to a trunk on the inside for holding clothes by dress hangers, wherein said base has a chamber on the inside, a rectangular front opening on a front end thereof, a plurality of resilient hook members inserted through said rectangular front opening into said chamber, a top hole, and a plurality of transverse grooves through said chamber at the bottom, each resilient hook member having a triangular stop block respectively hooked in said top hole, a spring arm stopped against a back wall inside said chamber, a knob extended out of said rectangular front opening, and a bottom hook disposed over either transverse groove, the bottom hook of either resilient hook member being moved backward, by pressing the respective knob inward in squeezing the respective spring arm against said back wall, to open the respective transverse groove for hanging or removing a dress hanger.

* * * * *